United States Patent [19]

Wilhelm

[11] 4,169,498

[45] Oct. 2, 1979

[54] METHOD FOR THE SECONDARY COOLING OF A METAL STRAND

[76] Inventor: Werner Wilhelm, Auf der Ürfte 3a, 4320 Hattingen 13, Fed. Rep. of Germany

[21] Appl. No.: 848,597

[22] Filed: Nov. 4, 1977

[30] Foreign Application Priority Data

Nov. 12, 1976 [DE] Fed. Rep. of Germany ..... 2651573

[51] Int. Cl.[2] ..... B22D 11/124; B22D 11/12

[52] U.S. Cl. ..... 164/4; 164/89; 164/414; 164/444

[58] Field of Search ..... 164/4, 82, 89, 414, 164/443, 348, 154, 444, 76

[56] References Cited

U.S. PATENT DOCUMENTS

| | | | |
|---|---|---|---|
| 3,364,977 | 1/1968 | Machida | 164/89 |
| 3,915,216 | 10/1975 | Fekete et al. | 164/89 |
| 4,009,750 | 3/1977 | Fekete et al. | 164/414 |

FOREIGN PATENT DOCUMENTS

| | | | |
|---|---|---|---|
| 388832 | 11/1973 | U.S.S.R. | 164/89 |

*Primary Examiner*—Robert D. Baldwin
*Assistant Examiner*—K. Y. Lin
*Attorney, Agent, or Firm*—Martin A. Farber

[57] ABSTRACT

Method and apparatus for secondary cooling of a metal strand particularly of steel by the quantity-controlled spraying of a coolant in individual cooling areas by means of nozzles on areal portions of the strand surface, which as a consequence of the strand advance are intermittently cooled in the sprayed areal portions and reheated in the unsprayed portions by the continuing heat flow from the inside of the strand, whereby the coolant quantities which are fed to the nozzles of the individual cooling areas are controlled according to predetermined values. The coolant quantity per unit time $Q_t$ (l/min) fed to each nozzle proportionally to the strand advance speed is controlled according to predetermined values of the coolant quantity $Q_S$ (l/m$^2$) which is fed to each strand surface unit by a nozzle. The coolant quantity $Q_S$ for the individual cooling area (the location of which cooling areas are determined by a distance x of that nozzle of each cooling areas from the continuous casting mould in % of the total secondary cooling length, which nozzle is furthest away from the continuous casting mould) is regulated to values, which in a graph of the coolant quantity $Q_S$ over the secondary cooling length lie between the points of intersection, with particular graph curves, of perpendicular lines drawn at the location of said nozzle of the individual cooling areas plotted on the abscissa which is most distant from the continuous casting mould.

8 Claims, 10 Drawing Figures

Figure 6:
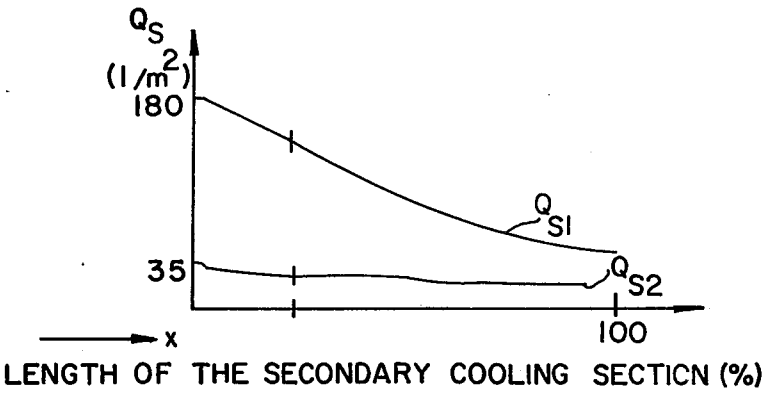

Fig. 5a
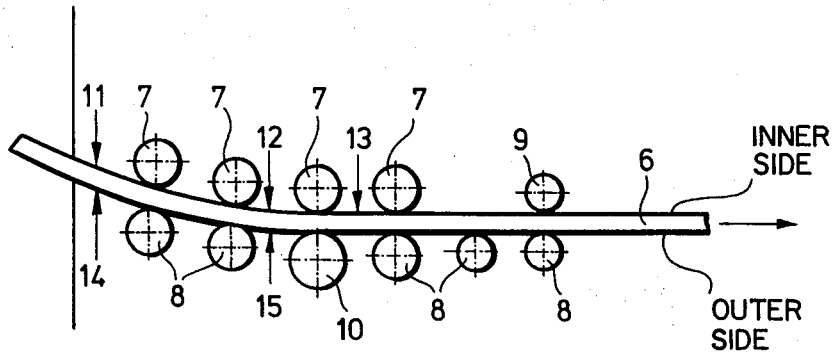
Fig. 5b
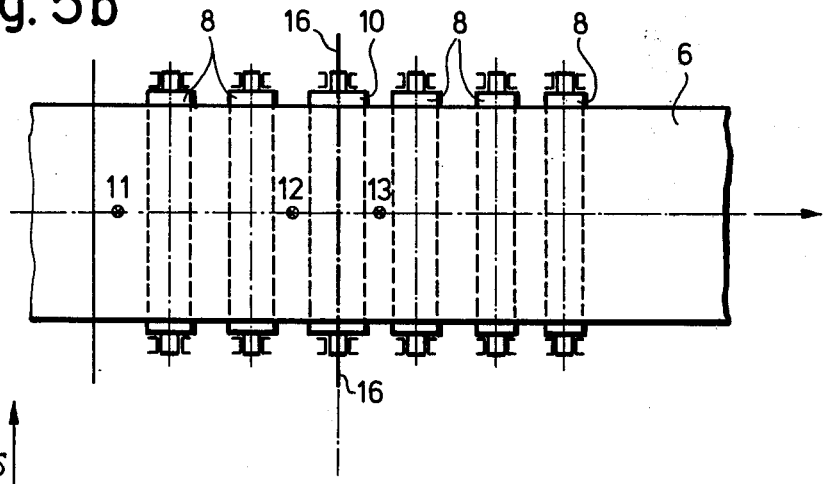
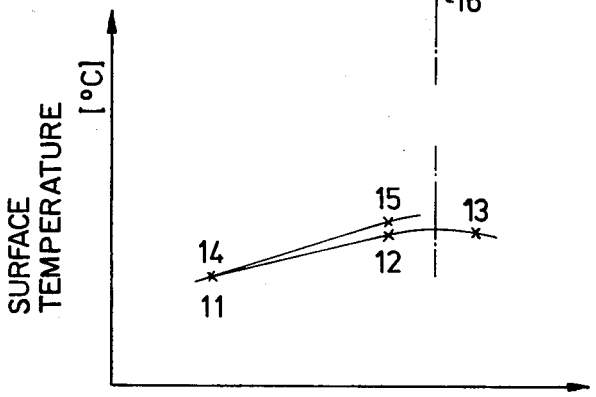
Fig. 5c

METHOD FOR THE SECONDARY COOLING OF A METAL STRAND

The invention relates to a process for the secondary cooling of a metal strand, particularly of steel, by spraying controlled amounts of a coolant in individual cooling regions with nozzles. In this process for the secondary cooling the strand shell is intermittently cooled on the surface in areal sections in each case due to the advance of the strip, and is reheated by the heat flowing from the inside of the strip. The amounts of coolant fed to the nozzles in the individual cooling regions are controlled according to predetermined values.

The present invention also relates to a device for carrying out this process.

During the continuous casting of metals, the molten metal is precooled in a water-cooled mold to such an extent that a strand having a relatively thin solidified strand shell emerges from the mold. After the primary cooling in the mold the strand passes into an aftercooling section, called a secondary cooling section, in which it is cooled somewhat until it is completely solidified therethrough, usually will sprayed water as the coolant. Depending on the metal analysis the strand reacts very sensitively to the cooling conditions so that in case of unsuitable cooling, cracks can easily arise.

In order to counteract the formulation of cracks, it is known to divide the aftercooling section into several zones and to apply the strand with amounts of coolant which differ from cooling zone to cooling zone. The variation of the amounts of coolant from zone to zone takes place customarily under consideration of the increasing strand shell and the heat transfer which becomes lower therewith. The amounts of coolant to be used depend among other things on the composition of the metal, the cross-section of the strand, the passage of heat, the surface quality, the steam generation on the strand surface, the coolant temperature, the kinetic energy of the coolant as well as on the geometry of the nozzle.

For adjusting the cooling conditions over the length of the strand a number of processes are known in which the control or adjustment of the coolant action on the strip is carried out, for example, as a function of the surface temperature, the rate of advance and the degree of cooling already brought about.

A process for adjusting the surface temperature of the strand to a predetermined value over the cooling zones of an aftercooling section is known from German Offenlegungsschrift No. 1,960,671. In this process the strand is cooled taking into account the shell thickness increasing in the direction of advance in each cooling area corresponding to the heat transfer, which decreases as the shell thickness increases. The more remote the prevailing zone from the mold, the smaller will be the amounts of coolant charged in the individual zones of the aftercooling sections. The control of coolant is carried out in such a manner that a nominal value for the amount of coolant calculated as a function of different actuating variables or limiting quantities, is predetermined for each cooling area, which value is to assure a predeterminability of the surface temperature of the strand.

The occurrence of cracks in the region near the surface cannot be avoided with this control. It is subsequently necessary to remove the arising cracks, for example, by scarfing or polishing.

From German Auslegesschrift AS No. 1,117,267 the use of another control means is known. There the amount of coolant required for uniform cooling under the circumstances is controlled as a function of the speed of the strand. This takes place in the manner that the control values for the cooling liquid are controlled by the strand draw-off mechanism and that correspondingly larger amounts of coolant are fed to the nozzle with higher draw-off speed and smaller amounts of coolant with decreasing strand speed.

In the secondary cooling known from the German Auslegesschrift No. 2,344,438, theoretical values computed as a function of the metal composition, the strand cross-section and the casting speed are predetermined for the control of the amount of coolant water, with which the coolant quantities actually used in a cooling area are compared with the theoretical values for the determination of the residual coolant quantity still to be applied. The length of the individual cooling section areas and/or the total length of the cooling section is changed accordingly. The residence time of the individual strand sections in the entire cooling area is kept constant.

In practice it has been found that despite the application of the measures disclosed in the three specifications more or less marked cracks frequently occur in the strand section near the surface. Such type of cracks, which are the cause of increased loss and expenditure for repairs, always arise when stresses due to cooling, structural changes and bending of the strand can no longer be assumed by the material of the strand; when reaching the yield point of the material of the strand at the time, the strand surface cracks.

In order to avoid cracks in the section near the surface, attempts had been heretofore made to avoid the formation of excessive stresses in the strand shell by means of relatively small amounts of coolant. However, this was not successful and yet additionally proved to be disadvantageous insofar as this was connected with a slower solidification of the strand and an extension of its semi-solid depth. This leads to marked center segregations and inhomogeneities with impairments with respect to mechanical properties, weldability and internal defects in the final product; moreover, lower rates of strand advance with higher specific processing costs as well as longer secondary cooling areas with higher installation costs must be accepted.

The invention is based on the task of providing a process and a device for the secondary cooling of a metal strand, with which surface flaws are avoided and which also insures the advantages of rapid complete solidification of the strand.

The solution of the invention is based on the concept of cooling the strand surface so intensively that the largest possible differences in temperature occur between the cooled and the reheating surface sections, whereby correspondingly high relative length changes are produced in these sections, which along with the corresponding stresses between yield point and tensile strengths, start a recrystallization and a structural change of the strand, which in turn produces a fine-grained casting structure in the region near the surface, which structure is particularly suited for avoiding surface flaws. The intensive cooling necessarily results in a reduction in the time of solidification of the cross-section of the strand and thus avoids the above-mentioned disadvantages.

In particular the invention resides in that the quantity of coolant per unit time $Q_l$ (liters per minute) which is fed to each nozzle proportionally to the rate or speed of the strand advance is controlled according to predetermined values of the quantity of coolant $Q_s$ (liters per square meter) which is fed by a nozzle to each strand surface unit, and that the quantity of coolant $Q_s$ (liters per square meter) for the individual cooling areas (the location of which individual cooling areas are determined by a distance x of that nozzle of each cooling area from the continuous casting mold in % of the total secondary cooling length, which nozzle is most distant from the continuous casting mold) is adjusted to values, which in a graph of the coolant quantity $Q_s$ (1/m$^2$) over the secondary cooling length lie between the points of intersection of the perpendicular lines erected at the location of the nozzle (which is most distant from the continuous casting mould) of the individual cooling areas (plotted on the abscissa) with the curves from the formulae

| | | | |
|---|---|---|---|
| $Q_{S1}$(l/m$^2$) = | −0.3637 | · | $10^{-7}x^5$ |
| | +9.5677 | · | $10^{-6}x^4$ |
| | −0.08935 | · | $10^{-2}x^3$ |
| | +0.03560 | · | $x^2$ |
| | −0.8029 | · | x |
| | +34.27 | | |
| and | | | |
| $Q_{S2}$ (l/m$^2$) = | −5.08378 | · | $10^{-9}x^6$ |
| | +1.780545 | · | $10^{-6}x^5$ |
| | −2.413606 | · | $10^{-4}x^4$ |
| | +1.56592 | · | $10^{-2}x^3$ |
| | −0.46323 | · | $x^2$ |
| | +2.607 | · | x |
| | +176.8 | | |

The predetermined values $Q_S$ have a determined magnitude. They are high such that substantially more water per unit time than heretofore arrives on the strand surface in front of each nozzle. The predetermined values $Q_S$ lie inside of two curves (FIG. 6) which are given by the mathematical relationships $Q_{S1}$ and $Q_{S2}$.

The predetermined values are so dimensioned that the local tensile and compressive stresses occurring in the strand shell in the section close to the surface in adjacent areal portions, which lie between the yield point and tensile strength, cause a recrystallisation and structural conversion, by which a structure is formed which is particularly appropriate to avert surface faults. The predetermined values correspond to the coolant quantity which had been applied to a strand surface unit upon traversal of the spraying range of a nozzle. The predetermined values consequently represent a parameter for the cooling, which each strand surface unit had undergone during the traversal of the spraying range or area of one nozzle. The nozzles are so selected and their spraying areas so arranged, that each strand surface unit is cooled as identically and as intensively as possible (cooling intensity).

The coolant quantity $Q_S$ is preferably kept constant within the separate cooling areas. The time sequence of the secondary cooling operation may be subdivided into several and preferably three operating phases "start of insertion to end of insertion," "end of insertion to termination of casting" and "termination of casting to end of withdrawal," whereby the coolant quantity $Q_S$ being greater during the intermediate phase "end of insertion to termination of casting" than during the other operating phases and differs from cooling region to cooling region in all operating phases.

In accordance with an appropriate embodiment of the invention, the coolant quantity $Q_S$ reaches the values which lie between the points of intersection of the values x of each separate cooling area with the graphs derived from the formulae

| | | | |
|---|---|---|---|
| $Q_{S3}$ = | −0.45556 | · | $10^{-7}x^5$ |
| | +0.120184 | · | $10^{-4}x^4$ |
| | −0.112241 | · | $10^{-2}x^3$ |
| | +0.44719 | · | $10^{-1}x^2$ |
| | −1.009 | | x |
| | +43.11 | | |
| and | | | |
| $Q_{S2}$ = | −5.08378 | · | $10^{-9}x^6$ |
| | +1.780545 | · | $10^{-6}x^5$ |
| | −2.413606 | · | $10^{-4}x^4$ |
| | +1.56592 | · | $10^{-2}x^3$ |
| | −0.46323 | · | $x^2$ |
| | +2.607 | · | x |
| | +176.8 | | |

The predetermined values $Q_S$ are constant for each spraying nozzle within a cooling area, but differ from cooling area to cooling area. The predetermined values $Q_S$ are particularly high in the range of high strand surface temperatures, i.e., of a high capacity of morphological alteration of the strand material and high elasticity of the strand cross-section and decrease with diminishing temperature in the same degree as the decreasing morphological alteration capacity and the diminishing elasticity reduce the degree of plastic deformation possible without the risk of cracking. In accordance with the inventive teaching, each surface unit is exposed to an intensive cooling which, without cracking, exhausts the deformation capacity depending on the material, its temperature, the structural form and the segregations.

In practical operation, the secondary cooling area is subdivided into three to eight cooling areas, preferably into six cooling areas, arranged in the direction of withdrawal advance of the strand. The period in which a strand is moved through the secondary cooling area is subdivided into several operating range, preferably into three operating stages, that is 1. Beginning of insertion to end of insertion (entry of the strand start into the secondary cooling area until the end of the heating of the secondary cooling device by the strand and reaching the maximum semi solid depth)
2. End of insertion to termination of casting (until the end of the steel feed into the mould)
3. Termination of casting to end of withdrawal (until the strand end portion leaves the secondary cooling area).

To make allowance for the fact that the cooling conditions of the strand vary substantially as a consequence of changes in the cooling action, such as heating of the continuous casting system by the strand and growth of the semi-solid depth in the strand after the onset of casting, as well as interruption of feed of the steel, reduction of the semi-solid depth and the covering of the strand end portion at or after termination of casting, respectively, the coolant quantity $Q_S$ (liters/m$^2$) applied per surface unit in the inventive method in the operating stage "end of insertion to termination of casting" corresponds to a particular predetermined value which is greater than the predetermined values in the other operating stages. The predetermined value during the operating stage "beginning of insertion to end of insertion" preferably does not lie below 70% of the predetermined values of the operating stage "end of insertion to termination of casting," and the predetermined values have decreasing percentages during insertion and increasing percentages during withdrawal in the separate cooling areas in the direction of advance of the strand. In each operating stage, the predetermined values are constant within each cooling area and as a consequence of the proportionality between $Q_l$ and the speed (v) of advance of the strand independent of a change of the speed of advance of the strand.

It is advantageous if the predetermined values during the operating stage "termination of casting to end of withdrawal" amount to at least 20% of the predetermined values of the operating stage "end of insertion to termination of casting."

In a suitable embodiment of the invention, the spraying nozzles of the cooling areas are preferably arranged in such a manner in their spacing in the direction of advance of the strand and at right angles to the same that, in the region close to the strand surface, in the direction of advance of the strand as well as at right angles to the same, cooled regions under tensile stress alternate with reheated portions under compressive stress, and the portions under tensile stress are completely surrounded by the portions under compressive stress. This assures the largest possible stress peak equalization between the cooled and reheated regions and prevents reaching the yield point. An optimum stress peak equalization between the surface areas acted upon by the coolant, standing under tensile stress, and the surface areas no longer acted upon by the coolant, reheated from the inside of the strand and consequently standing under compressive stress, is the outcome if the tensile stress regions are arranged staggered with respect to each other in the direction of advance of the strand and have the form of rectangles turned through preferably 5° to 35° with respect to the perpendicular to the strand axis, as evident from the spray pattern of rectangular jet nozzles.

The staggered arrangement of the tensile stress regions in two or more nozzle planes has the result that the difference cooling intensities and thus stress intensities necessarily occurring in a sprayed surface in the direction of advance of the strand and at right angles to the same, are equalized upon passing through of the individual nozzle planes.

The tensile stress regions rotated with respect to the perpendicular to the strand axis lead to a subdivision of the spraying range coordinated with one nozzle plane into separate nozzle spray areas and thereby make possible a total surrounding of the tensile stress regions by compressive stress regions (FIG. 3) without any strand surface element failing to be sprayed upon traversing a nozzle plane. By the rotation of the nozzle spray areas moreover the disturbances and obstructions are eliminated in the forming of unturned adjacently situated spraying areas, which reside in that an accumulation of coolant occurs in the area of overlap before the strand surface is reached. Beyond this, the desirable inventive possibility of operating with large quantities of coolant on each strand surface unit, is achieved by the preferred nozzle design and spray area arrangement.

In consideration of an adequately intensive reheating of the strand surface with sufficiently high compressive stresses in the areas which are not sprayed, the spraying nozzles in accordance with the invention may be so arranged in the direction of advance of the extrusion and in their spacing from the strand surface, in such manner as to result in a ratio between the sprayed and unsprayed strand surface diminishing steadily in the direction of advance of the strand.

In accordance with the invention, special advantages are established if at the inner side of the curve of the strand has a surface temperature of 700 to 850° C. in the area of the bending line after leaving the secondary cooling area, and if the surface temperature reaches a relative maximum by heating from the inside, because compressive stresses are thereby produced as prestress for the tensile stresses arising during the bending action.

Finally, the surface temperature of the strand directly after the secondary cooling area should be the same in magnitude at the outer side as at the inner of the curve of the strand, but in the area of the bending reaction roller should be higher and preferably approximately 50° C. higher than at the inner of the curve of the strand (FIG. 5), so that the neutral vein is displaced in the direction towards inner of the curve of the strand during the bending of the strand, which leads to a lower tensile stress in the inner side of the curve of the strand. The required temperature difference may be obtained by the application of coolant and/or by an increase of the heat dissipation as a result of radiation on the inner side of the curve of the strand on the one hand and/or by heat-damaging measures at the outer side of the curve of the strand on the other hand.

An inventive device for application of the method described above for the secondary cooling of a metal strand is characterised in the manner that the nozzle arrangement and the spraying area pattern are such that each tensile stress area is surrounded by a compressive stress portion in the area close to the strand surface, whereby the areal portions acted upon by coolant can have the shape of rectangles turned with respect to the axis of the strand, and the ratio of the areal sections which are acted upon by the coolant to those which are not acted upon become smaller in the direction of advance of the strand. The nozzles are thereby advantageously arranged in the separate spraying areas while avoiding an overlap of their spraying ranges. The nozzles can advantageously be arranged in such manner with respect to the strand surface that the area which they act upon with coolant has the form of rectangles rotated by an angle $\alpha$ with respect to the perpendicular to the strand axis. The angle of rotation may amount to between 5° and 35°. The nozzle arrangement should be such that in each nozzle plane (FIG. 3) there results an uninterrupted spraying range extending across the extrusion width—as seen in the direction of advance of the strand.

Figure 1:
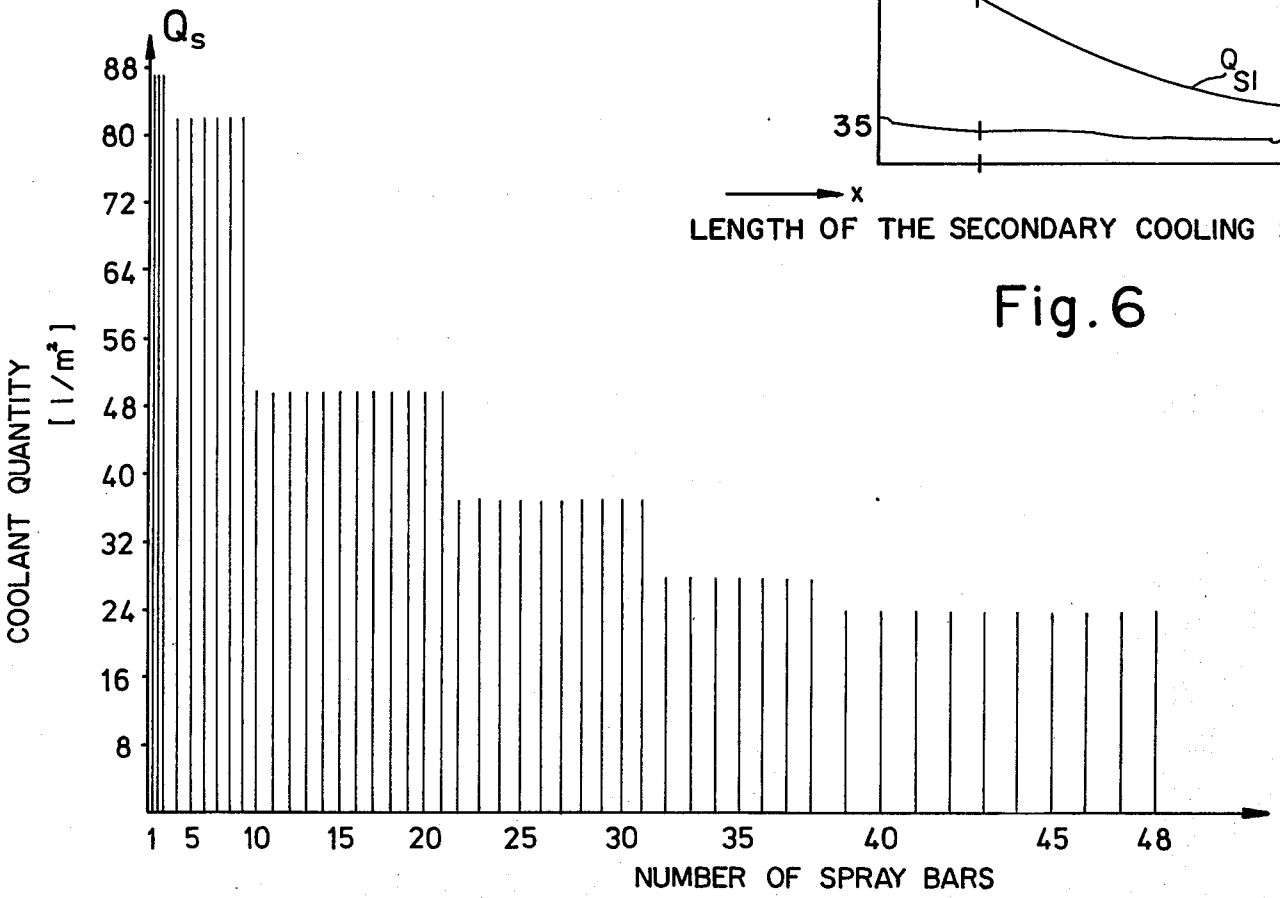

Other details of the invention result from the following description of an example of embodiment of the invention, illustrated in the drawings. In the drawings there are shown:

FIG. 1 predetermined values of the coolant quantity $Q_S$ for the six cooling areas of the inner side of the curve of a strand of a secondary cooling section of a continuous casting system in the operating stage "end of insertion to termination of casting,"

Figure 2:
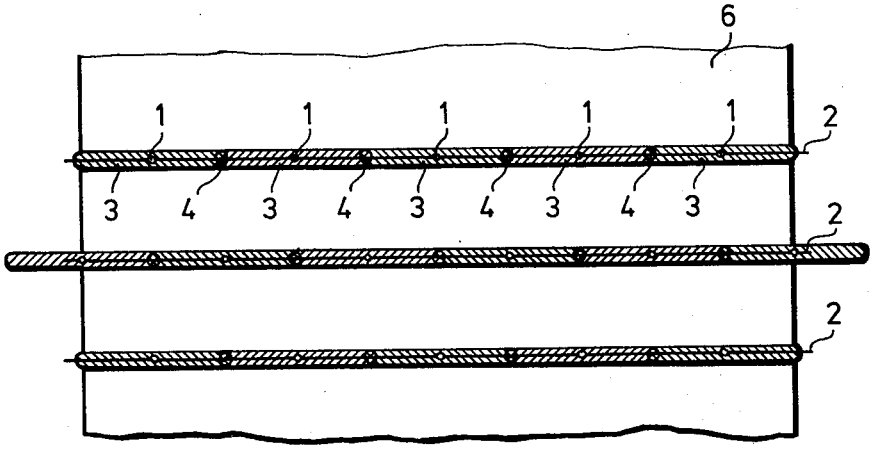
Figure 3:
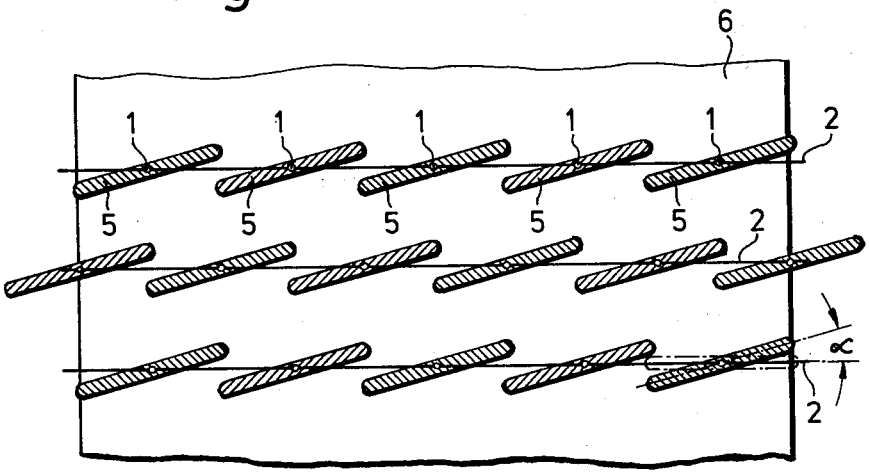
Figure 4C:
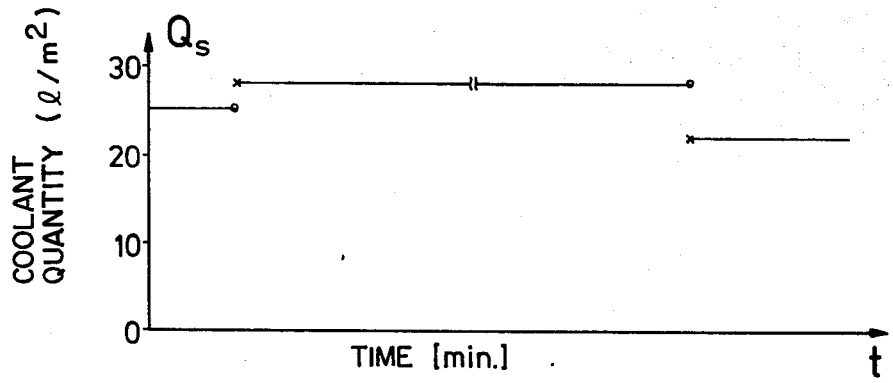
Figure 4B:
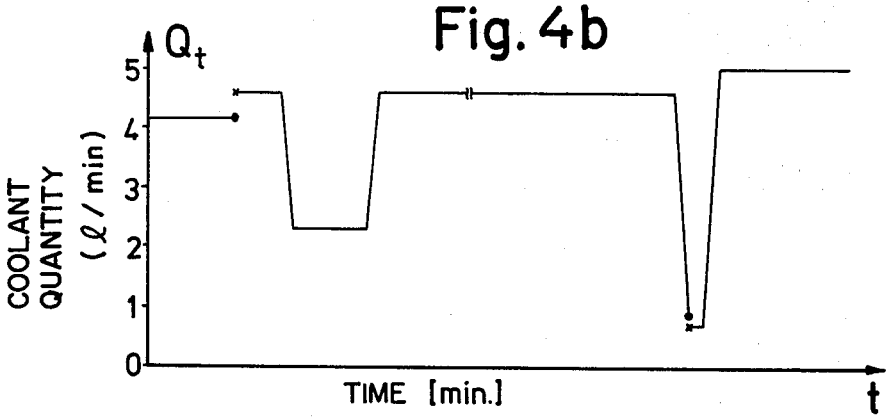
Figure 4A:
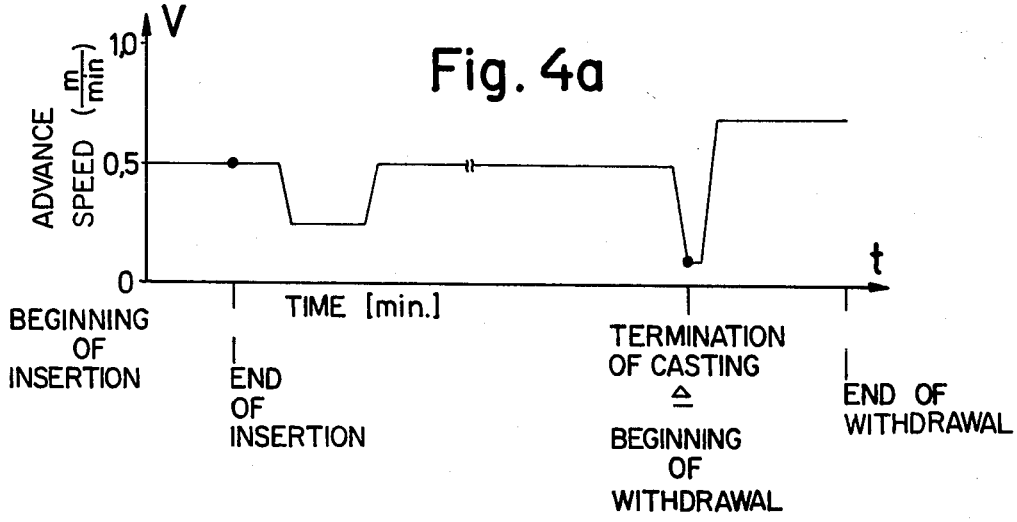

FIG. 2 a schematic arrangement of spraying nozzles on spray bars and the corresponding spraying areas according to prior art, FIG. 3 an illustration corresponding to FIG. 2 of the arrangement of spraying nozzles according to the invention, FIGS. 4*a*, 4*b* and 4*c* the variation of the speed of advance v of the strand, of the coolant quantity per unit time $Q_t$, and of the coolant quantity per unit of strand surface $Q_S$, with the time t from the "beginning of the insertion to the end of the withdrawal,"

FIGS. 5*a*, 5*b* and 5*c* show a withdrawal and straightening machine of a continuous casting system comprising temperature measuring points in side view and plan view, as well as the graph of the strand surface temperatures on the inner and outer sides of the curve of the strand respectively, and FIG. 6 is a graph of $Q_S$ vs. length of the secondary cooling section in %.

In FIG. 1, the predetermined values of the coolant quantity per strand surface unit ($1/m^2$) are plotted on the ordinate for an optional nozzle of each spray bar of the inner side of the entire secondary cooling section or area of a continuous casting system, and numbers 1 to 48 of the spray bars are plotted on the abscissa. The secondary cooling area thereby is subdivided into six cooling areas; the spray bars one to three form the first, the spray bars four to nine form the second, the spray bars then to twenty-one form the third, the spray bars twenty-two to thirty-one form the fourth, the spray bars thirty-two or thirty-eight form the fifth and the spray bars thirty-nine to forty-eight form the sixth cooling area. The values of the coolant quantity $Q_S$ apply for the operating stage "end of insertion to termination of casting." It is understood that the values apply only for a particular quality group and one continuous system.

FIG. 2 shows staggeredly arranged nozzles 1 of three spray bars 2, the spraying areas 3 of which overlap each other linearly in the area 4. In FIG. 3 with the same staggered arrangement of the nozzles 1 in the spray bars 2, the spraying areas 5 thereof are rotated by the angle $\alpha$ with respect to the perpendicular to the axis of the strand 6, whereby one teaching of the invention is schematically illustrated. The angularly rotated spraying areas lead to a complete encompassment of the sprayed areas of the strand 6 by non-sprayed areas and consequently to an optimum stress peak equalization between the two areas, without a strand surface area not being sprayed during the traversal of a nozzle plane. Moreover, disturbances and obstructions in the formation of the spray fields or areas as they occur with the overlappings according to FIG. 2 are eliminated by the rotation of the nozzle spray areas. Let reference be made to the spraying area at the bottom right in FIG. 3 of the end nozzle shown, in which it is indicated in schematic dash-dotted manner how the rotation of the spraying areas should be undertaken in accordance with the invention; namely in such manner that the outer tips of a spraying area still engage strand surface elements which are again covered by the tips of the spraying areas or fields which are arranged therebelow. A uniform intensity of the cooling is thereby assured even in the areas in which an attenuation would normally be expected on the basis of the spray pattern of the nozzles.

In FIGS. 4*a*, 4*c* and 4*b* the strand advance speed v (m/min), the coolant quantities per strand surface unit $Q_S(1/m^2)$ and the corresponding coolant quantities per unit time $Q_t$ (1/min), respectively, which predetermined for a nozzle for the three operating stages "beginning of insertion to end of insertion," "end of insertion to termination of casting" and "termination of casting to end of withdrawal," are plotted over the casting period t (min). The mathematical relationship between the predetermined coolant quantity $Q_S$ and the coolant quantity $Q_t$ applied per unit of time is given by the formula $$Q_S = Q_t / B \cdot v \; (1/m^2)$$

in which "B" is the effective spraying width of a nozzle measured in the dimension "meter". The quotient thereby is $$Q_t / v = \text{constant.}$$

The withdrawal and straightening unit illustrated in FIG. 5 comprises nine rollers 7, 8, one bending roller 9 and a bending reaction roller 10; it has five temperature measurement points 11 to 15 which, for monitoring, are arranged mutually opposite each other in the middle of the inner side and the outer side of the curve of the strand in the area of the withdrawl and straightening unit behind the secondary cooling area. The measurement points 12 and 13 are arranged directly in front and behind, respectively, of the bending reaction roffler 10 in the middle of the inner side of the curve of the strand. The measurement point 15 lies opposite the measurement point 12 in front of the bending reaction roller 10 in the middle of the outer side of the curve of the strand. The maintainance of the nominal values which are predetermined for the five temperature measurement points means that the strand surface and the inside of the strand have undergone the specified cooling in the secondary cooling area, in which inner side of the curve of the strand compressive stresses were built up in the area of the bending line, as a preloading for the tensile stresses occurring during the bending, and that moreover the neutral vein has been shifted in the direction of the inner side of the curve of the strand in the cross-section for reduction of the bending tensile stresses.

The graph of the strand surface temperatures at the inner and outer sides of the curve of the strand 6, as well as the position of the bending line 16 moreover are illustrated in FIGS. 5*a* 5*b* and 5*c*.

A charge of 150 tons of steel of the composition:

| | | |
|---|---|---|
| 0.06 | to 0.09% | carbon |
| 0.2 | to 0.3% | silicon |
| 1.45 | to 1.60% | manganese |
| 0.04 | to 0.05% | columbium |
| 0.025 | to 0.045% | aluminum |
| 0.07 | to 0.09% | vanadium |
| no more than | 0.015% | phosphorous |
| no more than | 0.006% | sulfur |
| remainder iron | | |

was poured at a temperature of 1568° C. into a water-cooled copper casting mould having a height of 700 mm, a width of 2100 mm and a thickness of 300 mm. The specified strand advance speed amounted to 500 mm/min until the termination of casting, and to 700 mm/min from termination of casting. The secondary cooling area of an overall length of 15 m was subdivided into six cooling areas (FIG. 1), whereby the spraying bars 2 were equipped with nozzles 1 according to FIG. 3 and amounted to the angle $\alpha = 15°$. Water was used as a secondary coolant with a temperature of 25° to 30° C. and a pressure in front of the spraying bars 2 from 1.5 to 3.5 bar.

The following predetermined values for the coolant quantity $Q_S$ are applicable in the individual cooling areas during the individual operating stages, according to which the coolant quantities per unit time $Q_l$ fed to each nozzle 1 were controlled:

| Distance of the spray nozzles from the continuous casting mould in % of the total secondary cooling length | insertion ($l/m^2$) | end of insertion to termination of casting ($l/m^2$) | withdrawal ($l/m^2$) |
|---|---|---|---|
| 0–1.7 | 83.5 | 87 | 17.4 |
| > 1.7–10 | 78.1 | 84.4 | 18.7 |
| >10–30 | 45 | 50 | 19.7 |
| >30–50 | 32.6 | 37 | 27.8 |
| >50–70 | 24.2 | 28 | 22 |
| >70–100 | 20.4 | 24 | 18.9 |

For basis of definition, the nozzle which is the last each in a cooling area, i.e., the nozzle farthest away from the mould, is made the basis for calcuations for specification of the predetermined values for the coolant quantity $Q_S$. A distance x of the last nozzle from the mould in % of the total secondary cooling length is obtained therefrom for each cooling area. In this table x = 1.7; 10; 30; 50; 70; 100 for the six cooling areas.

The operating stages "insertion" and "withdrawal," respectively, lasted 30 minutes maximum and 21 minutes maximum, respectively, for the individual cooling areas. The predetermined values $Q_S$ remained constant during each operating stage independent of a change of the strand advance speed (FIG. 4*c*).

For monitoring the control of the coolant quantities in the individual cooling areas, the surface temperatures of the strand after leaving the secondary cooling area were measured at five measuring points 11 to 15 (FIG. 5*c*). The measured temperatures established correspondence with the nominal values.

After a cooling on the cooling platform down to approximately 400° C., the individual strand slabs were piled up in stacks and cooled off in still air. All strand slabs were subjected to identical and intensive cooling in the secondary cooling section with the result of faultless surfaces, which made any flame or grinding of the slabs superfluous prior to insertion into the rolling unit. No scrap due to surface defects or internal defects resulted in the case of plates produced from the strand slabs. Microscopic examination of the plates did not disclose any central segregations.

On the whole, the inventive method offers substantial advantages; the better surface characteristics of the material attained by application of the inventive method requires no, or respectively, requires substantially less trimming, flame and grinding treatment, and leads to reduced waste with the rough strand slabs and plates produced from these.

Beyond this, the continuously cast slabs are characterised by lesser segregations and inhomogeneities, from which with the finished product leads to an improvement of the weldability, of the mechanical properties and of the wastage due to internal faults.

Furthermore, the inventive method allows the continuous casting of materials which are particularly prone to cracking and segregation, as well as of thicker cross-sections, whereby considerable cost advantages are obtained as compared to the existing productiom method from ignot casting.

Moreover, because of the intensive action, a faster setting through the strand occurs and thereby a reduction of its semi-solid depth, which leads to higher strand advance speeds with lower specific processing costs and shorter secondary cooling sections with lower plant investment and installation costs.

The lower thermal stress on the system components furthermore results in lower wear and consequently to reduced maintenance and repair.

Finally, with use of a cooling method in accordance with the invention, the possibility is available to design and construct the entire continuous casting system substantially simpler and consequently with more cost conservation.

I claim:

1. A method for secondary cooling of a metal strand of steel in particular, which is continuously cast in a continuous casting mould, by the quantity-controlled spraying of a coolant in individual cooling areas by means of nozzles on area portions of the strand surface, which as a consequence of advance of the strand are intermittently cooled in the sprayed area portions and reheated in the unsprayed portions by the continuing heat flow from the inside of the strand, whereby the coolant quantities which are fed to the nozzles of the individual cooling areas are cpntrolled according to predetermined values, comprising the steps of controlling the coolant quantity per unit time $Q_l$ (l/min) fed to each nozzle proportionally to the strand advance speed as a function of predetermined values of the coolant quantity $Q_S$ ($l/m^2$) which is fed to each strand surface unit by a nozzle, determining the location of the individual cooling areas by a distance x of a nozzle of each of said individual cooling areas from the continuous casting mould in % of a total secondary cooling length, said nozzle of each of said individual cooling areas being that most distant from the continuous casting mould, adjusting the coolant quantity $Q_S$ for said individual cooling areas to values, which in a graph of the coolant quantity $Q_S$ over the secondary cooling length lie between points of intersection of perpendicular lines drawn at the location of said nozzle of each of said individual cooling areas plotted on the abscissa with curves of the formulae

| | | | | |
|---|---|---|---|---|
| $[S_{S1}]\ Q_{S1}$ ($l/m^2$) | = | 0.3637 | · | $10^{-7}x^5$ |
| | | +9.5677 | · | $10^{-6}x^4$ |
| | | −0.08935 | · | $10^{-2}x^3$ |
| | | +0.03560 | · | $x^2$ |
| | | −0.8029 | · | x |
| | | +34.27 | | |
| and | | | | |
| $Q_{S2}$ ($l/m^2$) | = | −5.08378 | · | $10^{-9}x^6$ |
| | | +1.780545 | · | $10^{-6}x^5$ |
| | | −2.413606 | · | $10^{-4}x^4$ |
| | | +1.56592 | · | $10^{-2}x^3$ |
| | | −0.46323 | · | $x^2$ |
| | | +2.607 | · | x |
| | | +176.8 | | |

2. Method according to claim 1, characterised in that the coolant quantity $Q_S$ is kept constant within the individual cooling areas.

3. Method according to claim 1, characterised in that the time sequence of the secondary cooling is subdivided into several, preferably into three operating stages, "beginning of insertion to end of insertion," "end of insertion to termination of casting" and "termination of casting to end of withdrawal," whereby the coolant quantity $Q_S$ is greater in the intermediate stage "end of insertion to termination of casting" than in the other operating stages and is different from cooling area to cooling area in all operating stages.

4. Method according to one of the claim 1, characterised in that the coolant quantity $Q_S$ obtains the values which lie between the points of intersection of the values x of each individual cooling area with the graphs from the formulae

| | | | |
|---|---|---|---|
| $Q_{S3}$ (l/m²) = | −0.45556 | · | $10^{-7}x^5$ |
| | +0.120184 | · | $10^{-4}x^4$ |
| | −0.112241 | · | $10^{-2}x^3$ |
| | +0.44719 | · | $10^{-1}x^2$ |
| | −1.009 | · | x |
| | +43.11 | | |
| and | | | |
| $Q_{S2}$ (l/m²) = | −5.08378 | · | $10^{-9}x^6$ |
| | +1.780545 | · | $10^{-6}x^5$ |
| | −2.413606 | · | $10^{-4}x^4$ |
| | +1.56592 | · | $10^{-2}x^3$ |
| | −0.46323 | · | $x^2$ |
| | +2.607 | · | x |
| | +176.8 | | |

5. Method according to claim 3, characterised in that the predetermined values during the operating stage "beginning of insertion to end of insertion" amount to at least 70% of the predetermined values of the operating stage "end of insertion to termination of casting" and have percentages decreasing in the direction of advance of the strand in the individual cooling areas.

6. Method according to claim 3, characterised in that the predetermined values in the operating stage "termination of casting to end of withdrawal" amount to at least 20% of the predetermined values of the operating stage "end of insertion to termination of casting" and have percentages increasing in the direction of advance of the strand in the individual cooling areas.

7. The method according to claim 1 wherein each element of the strand has a surface temperature of between 700° and 850° C. in the area of a bending line, and the surface temperature of each strand element has a relative maximum in the area of a bending reaction roller during passage through a withdrawal and straightening unit.

8. The method according to claim 7, wherein the surface temperature of the strand is lower at an inner side of the curve of the strand than at an outer side of the curve of the strand in the area of the bending reaction roller.

* * * * *